United States Patent [19]

Hodge et al.

[11] 4,147,215

[45] Apr. 3, 1979

[54] INDEPENDENTLY POWERED BREAKOUT APPARATUS AND METHOD FOR A SECTIONAL DRILL STRING

[75] Inventors: Lee R. Hodge, Houston; John M. Crowell, Friendswood; Richard A. Rogers, Houston, all of Tex.

[73] Assignee: Hughes Tool Company, Houston, Tex.

[21] Appl. No.: 884,870

[22] Filed: Mar. 9, 1978

[51] Int. Cl.[2] ..... B25B 17/00; E21B 3/00; E21B 19/16

[52] U.S. Cl. ..... 166/315; 81/57.16; 81/57.34; 166/77.5; 173/164

[58] Field of Search ..... 166/77.5, 315; 173/164; 81/57.16, 57.34

[56] References Cited

U.S. PATENT DOCUMENTS

| | | | |
|---|---|---|---|
| Re. 28,351 | 3/1975 | Dyer | 173/164 |
| 2,871,743 | 2/1959 | Kelley | 81/57.34 |
| 2,972,388 | 2/1961 | Thornburg | 175/52 |
| 3,158,213 | 11/1964 | O'Neill et al. | 175/85 |
| 3,460,638 | 8/1969 | Millsapps, Jr. | 175/85 |
| 3,463,247 | 8/1969 | Klein | 173/164 |
| 3,554,298 | 1/1971 | Klein | 173/164 |
| 3,629,927 | 12/1971 | Palmer et al. | 81/57.34 X |
| 3,680,412 | 8/1972 | Mayer et al. | 81/57.34 |
| 3,695,364 | 10/1972 | Porter el al. | 173/164 X |
| 3,722,603 | 3/1973 | Brown | 81/57.16 X |
| 3,799,009 | 3/1974 | Guier | 81/57.16 |
| 3,844,547 | 10/1974 | Lang et al. | 173/164 X |
| 3,851,714 | 12/1974 | Visser et al. | 173/164 |
| 3,902,385 | 9/1975 | Haby | 81/57.3 X |
| 3,920,087 | 11/1975 | Hisey et al. | 173/164 |
| 3,980,143 | 9/1976 | Swartz et al. | 173/164 X |

*Primary Examiner*—Stephen J. Novosad
*Attorney, Agent, or Firm*—Robert A. Felsman

[57] ABSTRACT

An improved means for making up and breaking out sections of drill pipe is disclosed herein. The make-up and breakout system is adapted for drill rigs having powered rotaries and powered carriages for moving the rotary up and down the mast. A wrench is mounted to the carriage for gripping the first section of the pipe. Slips are mounted at the work table for gripping the second section of pipe to support the string of pipe and prevent its rotation. The wrench is powered independently of the rotary, and the wrench and rotary can also rotate a certain amount with respect to each other while the wrench is gripping the first section of pipe. The independent power of rotation allows the wrench to breakout the first section from the second section. It also allows the rotary to breakout the first section from the rotary while the wrench restrains the first section from rotation.

14 Claims, 8 Drawing Figures

INDEPENDENTLY POWERED BREAKOUT APPARATUS AND METHOD FOR A SECTIONAL DRILL STRING

BACKGROUND OF THE INVENTION

1. Field of the Invention

This invention relates in general to earth boring machines, and in particular to an improved wrench mechanism for making up and breaking out sections of pipe of a drill string.

2. Description of the Prior Art

One type of earth boring machine uses a powered rotary that is mounted to a carriage which moves up and down the mast. The top section of the drill string is connected to a threaded connection at the rotary. Slips are normally located at a work table for supporting the weight of the drill string when disconnected from the rotary. The slips are also used to prevent the drill string from rotating when another pipe section or the rotary is being connected or disconnected to the drill string.

When removing sections of pipe from the borehole, normally a first or top section of pipe is pulled up into the mast so that its connection with the second or next lower joint is exposed. The slips are then set to support the string and to prevent the string from rotating. If the rotary is then rotated in reverse to unscrew the first section, either the lower connection or the upper connection will break. If the lower connection breaks first, then the first section can be restrained with a wrench while the upper connection is broken. However, if the upper connection section breaks first, some means is required to transmit torque from the rotary to the first pipe section to break the lower connection.

One type of breakout mechanism, as shown in U.S. Pat. Nos. Re. 28,351 and 3,695,364, deliberately loosens the upper connection first. In the first patent, the upper connection is broken while the first section is still in the borehole and held by the slips. In the second patent, an attempt is made to loosen the upper connection first while out of the hole, but if the lower connection happens to loosen first, the first section must be lowered back into the hole so that it can be grasped by the slips. The drill string is then pulled up to expose the lower connection, while the upper connection at the rotary is still in the loosened condition. Then a wrench, connected to the rotary, slides down and locks the first section to the rotary by the use of keys inserted in flats in the drill pipe. The rotary is then rotated in reverse to breakout the lower connection.

One disadvantage of this arrangement is that when using very heavy strings such as in blind shaft drilling, damage to the loosened threads may occur during lifting. Also, very high pitch threads are being used now that allow complete uncoupling in approximately one full turn. Consequently a danger exists that the string may be dropped when lifting with loosened threads. Other solutions, as shown in U.S. Pat. No. 3,680,412, have a breakout mechanism that operates independent of the rotary and is positioned directly at the lower connection. However, additional means are required to restrain the upper section when the rotary is reversed to breakout the upper connection.

Another solution to the problem of removing sections of drill pipe is shown in U.S. Pat. No. 4,037,672. The device disclosed therein utilizes a control system with different torques for drilling, for make-up, and for breakout. During pipe removal, the upper connection is further tightened to a torque greater than the original make-up torque between the first and second section, to assure that the lower connection will break first. While successful, another approach rather than multiple torques is desired.

The system shown in U.S. Pat. No. 4,037,672 also discloses drill pipe having vertical slots for engagement by the gripping means as an improvement over flats such as shown in U.S. Pat. No. 3,460,638. If the pipe is not quite vertical with the mast, the vertical dogs of the wrenching means will not bear evenly against the sidewall of the slot. Uneven loading may cause breakage of a dog.

SUMMARY OF THE INVENTION

It is accordingly a general object of the invention to provide an improved breakout apparatus for an earth boring drill rig.

It is a further object of the invention to provide an improved breakout apparatus that assures that the lower connection will break first, then allows the upper connection to be broken from the rotary.

It is a further object to provide an improved breakout apparatus that utilizes drill pipe with vertical slots, and assures that the wrench dogs are always aligned with the slots.

In accordance with these objects, an improved breakout and make-up apparatus is provided that has an upper wrench attached to the carriage below the rotary. The upper wrench has dogs that are adapted to engage slots in the upper collar of the first pipe section. A pair of hydraulic cylinders power the upper wrench independently of the rotary, causing the wrench to rotate a selected amount. Lower slips restrain the drill string, allowing the first pipe to be broken at the lower connection by the breakout wrench. The wrench then restrains the first pipe section while the rotary is reversed to breakout the upper connection.

The dogs in both the upper and lower wrenches are connected to cylindrical pistons that are allowed to pivot slightly about their axis to self align with the slots. Also the upper and lower wrenches are offset to allow the rotary to be lowered to the lower slips without having to pivot the upper wrench out of the way.

DESCRIPTION OF THE PREFERRED EMBODIMENT

Figure 1:
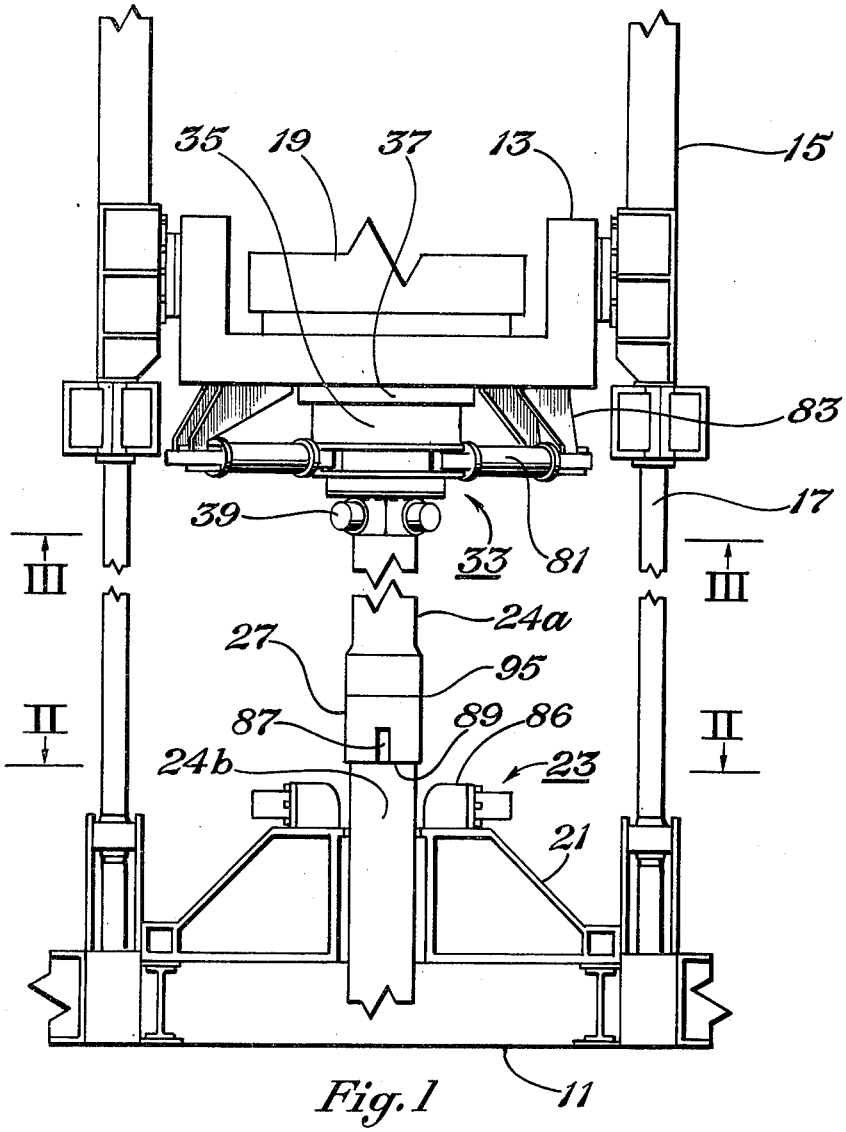
FIG. 1 is a front elevational view of a portion of a drill rig having a breakout apparatus constructed in accordance with this invention.

Referring to FIG. 1, a portion of a drill rig is shown including its base 11. A mast (not shown) such as shown in U.S. Pat. No. 4,037,672 extends generally upward from the base. A cross member or carriage 13 is mounted to the mast. Hydraulic cylinders 15, with piston ends 17 are mounted to the base 11 and serve as power means for moving the carriage 13 up and down the mast. Hydraulic cylinders 15 have been deleted from the cross-sectional views of FIGS. 2 and 3. Rotary drive means or rotary 19 is mounted in carriage 13 and is hydraulically powered for rotational movement in either direction. A work table 21 is carried by base 11. Slip means or slips 23 for supporting the drill pipe 24 in the borehole and restraining it from rotational movement are mounted to the top of the work table 21.

Figure 4:
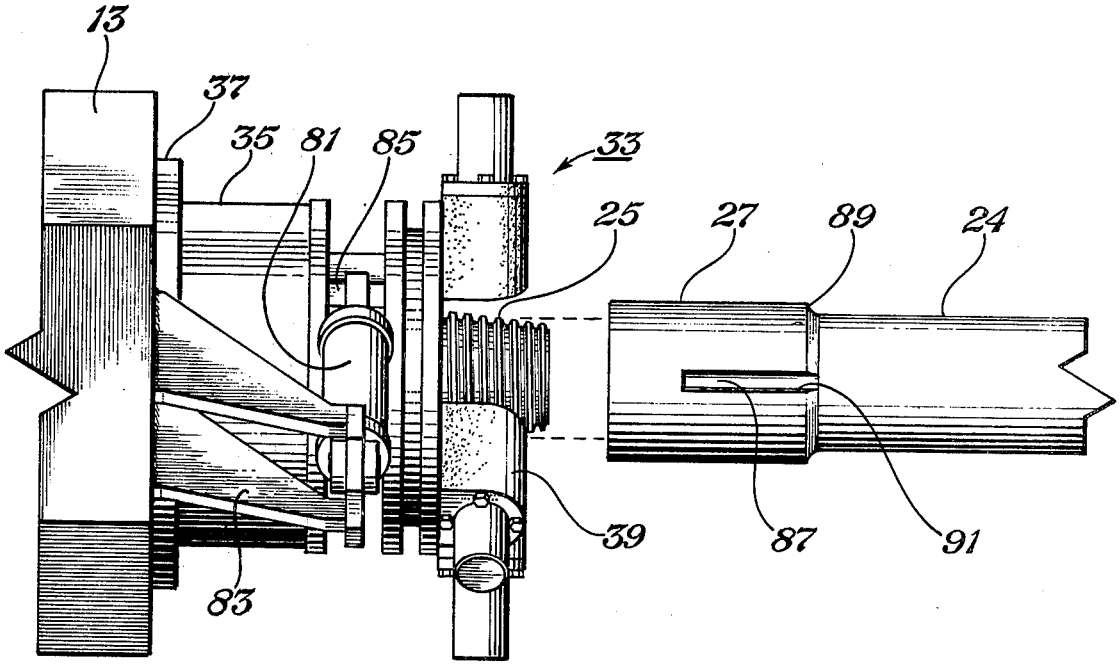
FIG. 4 is a view of the rotary and upper wrench of the drill rig of FIG. 1 tilted 90 degrees to receive a new pipe section.

Carriage 13 is a known type that will pivot 90 degrees, allowing the rotary 19 to pick up and lay down sections of drill pipe 24 as shown in FIG. 4. The rotary 19 is a known type having a threaded spindle or male pin 25 for connection to the upper tool joint or collar 27 of a pipe section 24. As shown by the dotted lines in FIG. 2, work table 21 is horizontally reciprocable, assuming vertical to be the direction the mast extends, regardless of its true orientation. Work table 21 will slide on base 11 in the directions perpendicular to the length of the mast to move the slips 23 around the drill pipe 24, but it cannot move vertically. A hydraulic motor 29 and screw assembly 31 reciprocate the work table 21, although hydraulic cylinders can perform this function also.

Figure 3:
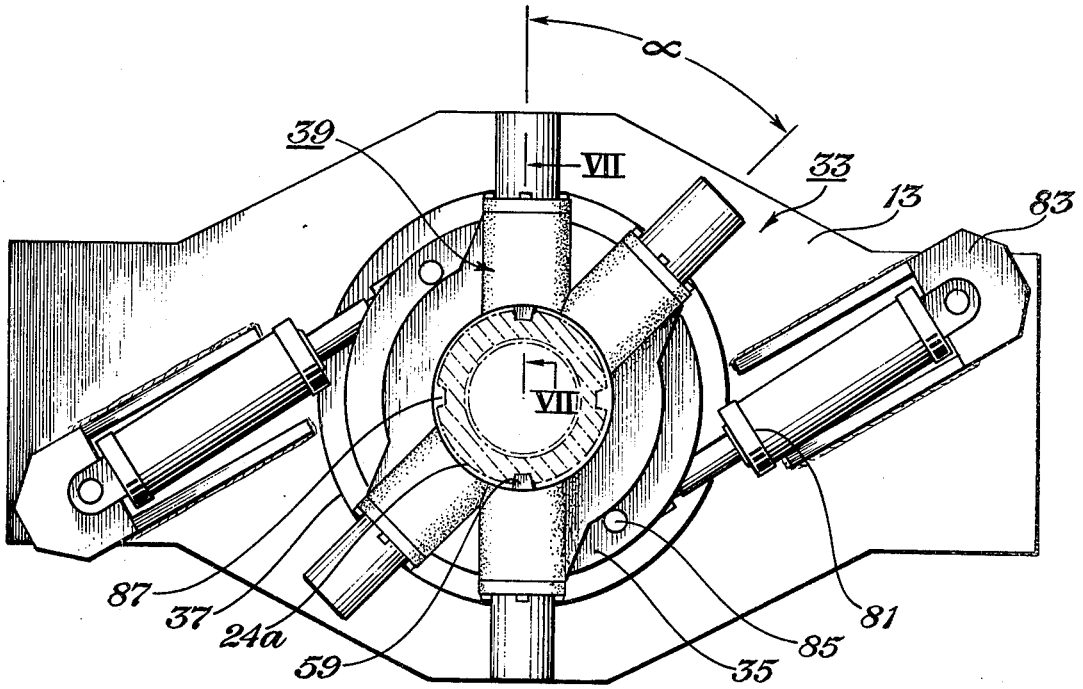
FIG. 3 is a partial cross-sectional view of the drill rig of FIG. 1 taken along the lines III—III.
Figure 7:
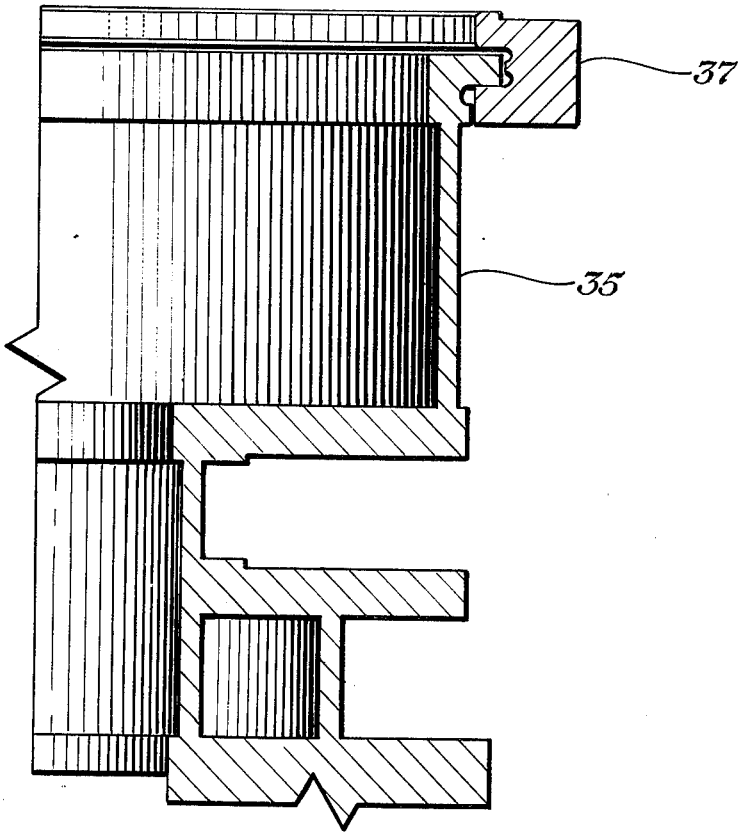
FIG. 7 is a partial cross-sectional view of the upper wrench of the drill rig of FIG. 1, taken along the lines VII—VII of FIG. 3.

Referring to FIG. 1, a wrench assembly 33 is mounted to the bottom of the carriage 13. Referring also to FIGS. 3, 4 and 7, the wrench assembly 33 includes a wrench housing 35 that is slidably mounted to carriage 13 by a retaining ring 37, which in turn is bolted to carriage 13. Retaining ring 37 allows wrench housing 35 to rotate with respect to the carriage 13, but it cannot move vertically or horizontally with respect to the carriage. Wrench housing 35 is generally cylindrical, of varying diameter, and surrounds the portion of rotary 19 at threaded pin 25.

Figure 6:
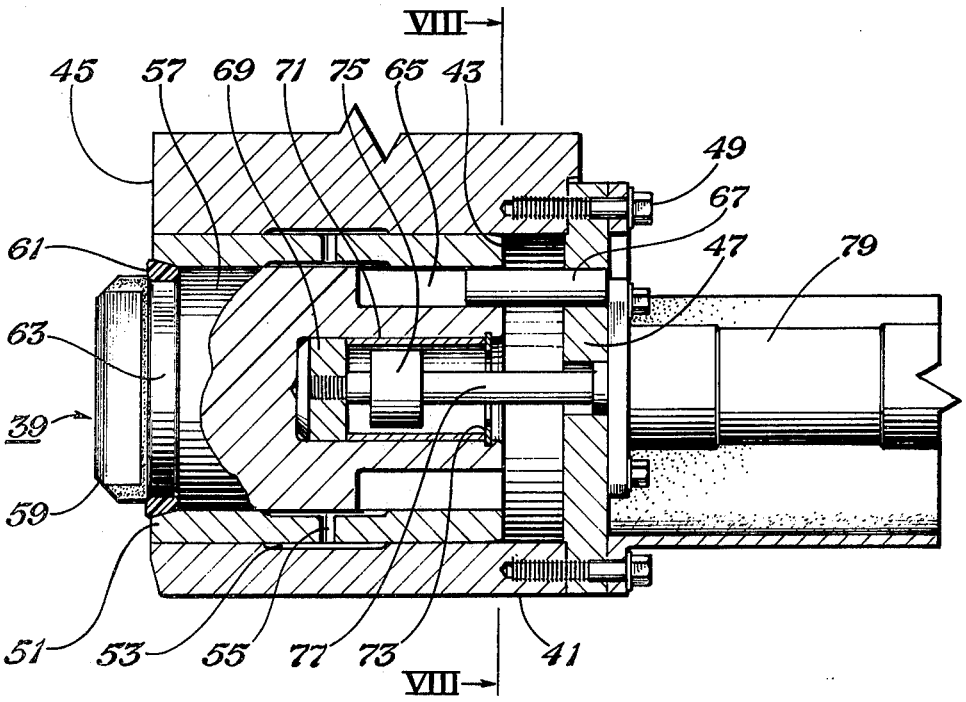
FIG. 6 is an enlarged sectional view of one of the breakout dog assemblies of the drill rig in FIG. 1.
Figure 8:
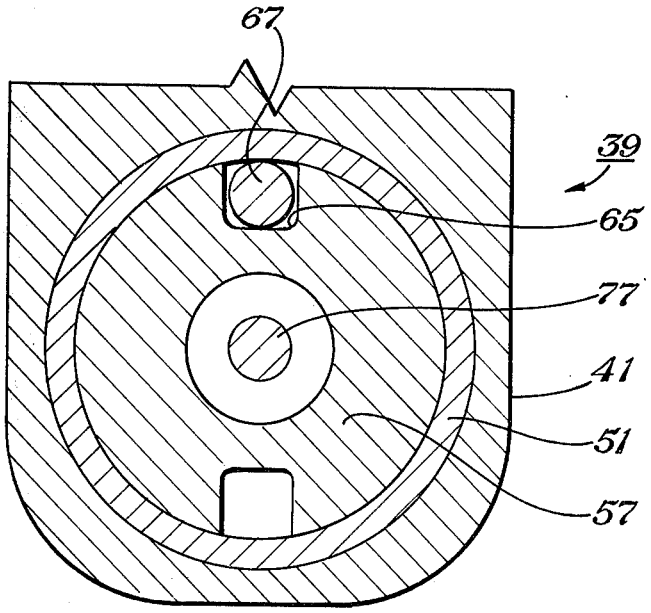
FIG. 8 is a cross-sectional view of the breakout dog assemblies of FIG. 6, taken along the lines VIII—VIII.

Four gripping means or assemblies 39 are welded to the bottom of the wrench housing 35. Referring to FIGS. 6 and 8, each gripping assembly 39 comprises a dog assembly housing 41 that is directly connected to the bottom of wrench housing 35. Dog assembly housing 41 has a bore 43, an open inner or front end 45, and an end plate 47 closing the outer end. End plate 47 is fastened to dog assembly housing 41 by bolts 49. A cylindrical sleeve 51 is interferringly secured in bore 43 so that it is immovable. Recesses 53 and ports 55 in sleeve 51 in bore 43 provide lubrication to the inner wall of sleeve 51.

A generally cylindrical piston 57 is reciprocally carried in sleeve 51. A dog 59 is secured to the face of piston 57. Dog 59 is of elongated rectangular configuration, being approximately 4 inches long, 2 inches wide and one inch thick. An annular seal 61 fits in a groove 63 in the walls of piston 57 at the face. Two slots 65 are formed in the walls of piston 57 at the rear.

A cylindrical pin 67 is interferringly secured in a hole in end plate 47 so that it is immovable. Pin 67 extends parallel with the piston axis into one of the slots 65. As shown is FIG. 8, slots 65 are elongated, or larger in width than the diameter of pin 67. This loose fit allows the piston 57 to pivot approximately two degrees to either side about its axis. The additional slot on the bottom of piston 57 allows it to be inverted if desired to even the wear on both sides of the dog 59.

Piston 57 has a central axial bore in its outer end containing a threaded nut 69 located at the base of the bore. A sleeve 71 secured in the bore by a retaining ring 73 bears against nut 69 to prevent it from axial movement. A coupler 75 is connected to nut 69. Piston end 77 of a hydraulic cylinder 79 extends through end plate 47 and is connected to coupler 75. Coupler 75, similar to a ball joint, can swivel a certain amount to align piston 77 with the threaded nut 69. Hydraulic cylinder 79, and the linkage means between it and piston 57, serve as reciprocating means to move the dog 59 in a plane perpendicular to the axis of the mast. In FIG. 6, the dog is in the inner, or engaged position. In the retracted position, the face of dog 59 will be substantially flush with the front end 45 of dog assembly housing 41.

Referring to FIG. 3, each gripping assembly 39 has an opposing gripping assembly spaced 180 degrees apart from it. The dogs of each gripping assembly of each pair face each other. One pair is spaced or offset from the other pair by an angle $\alpha$ of approximately 45 degrees. This spacing leaves a space proportional to 135 degrees extending from the axis of one gripping assembly 39 on one side of the pipe to the axis of the next gripping assembly 39 on the other side of the pipe.

Referring to FIGS. 1, 3 and 4, a pair of hydraulic cylinders 81 are pivotally mounted with their cylindrical ends to a bracket 83, which is secured to the bottom of carriage 13. The piston end of each cylinder is pivotally mounted to the wrench housing 35 by pin 85. Hydraulic cylinders 81 are aligned perpendicular to the axis of the mast and positioned so that stroking them causes the wrench housing to rotate approximately 60 degrees in either direction. Consequently hydraulic cylinder 81 provides rotational motion to the wrench assembly 33 independent of the rotary 19 rotational motion.

Figure 5:
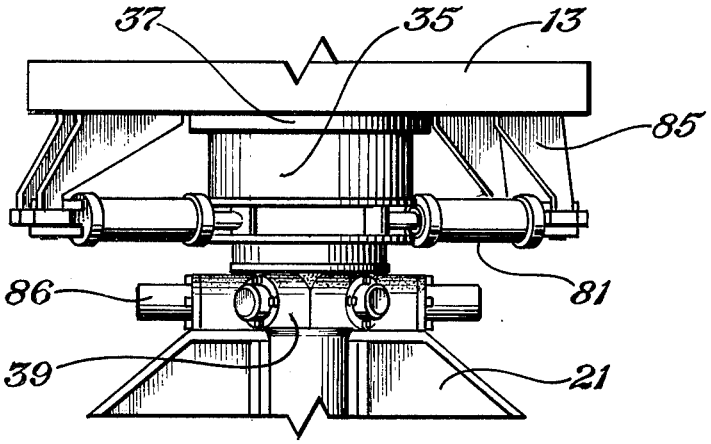
FIG. 5 is a view of the rotary and upper wrench of the drill rig of FIG. 1 lowered to the work table.

The slips 23 include two gripping assemblies 86 mounted to the top of work table 21 that are similar to the gripping assemblies 39. Their internal structure is the same as shown in FIGS. 6 and 8. Gripping assemblies 86 are mounted 180 degrees apart with their dogs opposing each other. The upper gripping assemblies 39 at wrench assembly 33 are offset from the lower gripping assemblies 86 so that they will intermesh when the rotary 19 is in its lowermost position, as shown in FIG. 5. Preferably a vertical plane passing through axes of the lower gripping assemblies 86 is parallel with the vertical plane of the mast. The vertical planes passing though the axes of the upper gripping assemblies 39 are not common with the vertical plane of the lower gripping assemblies 86 when the hydraulic cylinders 81 are in the retracted position. Rather the vertical plane of the lower gripping assemblies intersects the upper wrench assembly 33 in the 135 degree spaces between gripping assemblies 39.

As shown in FIG. 4, the upper or female collar 27 of each section of drill pipe 24 has four slots 87 equally spaced around the outer wall. Each slot 87 is rectangular and extends from the shoulder 89 of the collar 27 to about one half the collar length. Slots 87 are approximately 2 inches wide, 1 inch deep and have approximately 4 inches of sidewalls 91, with the upper end radiused as a result of the milling technique during manufacturing. Sidewalls 91 are aligned approximately on radial lines from the axis of pipe 24 to provide a good mating surface with dogs 59 for transmitting torque.

Slips 23 also include a U-shaped opening 93 on work table 21 for inserting around pipe 24. The diameter of opening 93 is not as large as the diameter of collar 27. Shoulder 89 of collar 27 bears against opening 93, which thus supports the weight of the drill string.

In operation, to begin drilling, the first section of drill pipe 24 is picked up as shown in FIG. 4. Carriage 13 is lowered to the level of the pipe handling device and pipe rack (not shown), then tilted 90 degrees. The female collar 27 of the first pipe section 24 is inserted over rotary threaded pin 25 and loosely connected. Wrench hydraulic cylinders 81 are actuated to align dogs 59 with slots 87. Hydraulic cylinders 79 are actuated to insert dogs 59 into slots 87. Then rotary 19 and threaded pin 25 are rotated to tighten the pipe section to the rotary, with the wrench assembly 33 serving as backup. The dogs 59 are retracted, and carriage 13 is tilted back to vertical position while lifting the pipe section. A bit or drilling structure connected to the pipe 24 and drilling is commenced. Rotary 19 provides the rotation during drilling.

Figure 2:
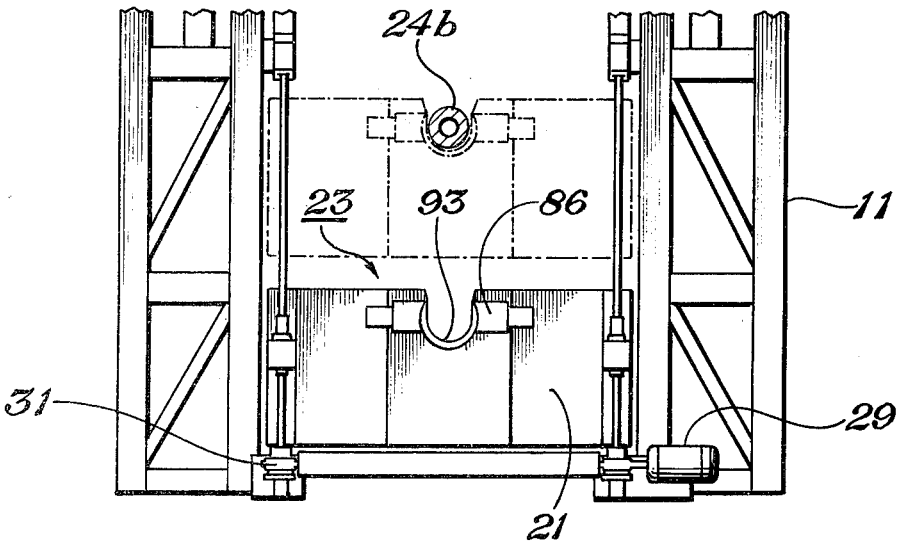
FIG. 2 is a partial cross-sectional view of the drill rig of FIG. 1 taken along the lines II—II.

When one pipe section length has been drilled down, rotary 19 will be in its lowermost position as shown in FIG. 5. Upper gripping assemblies 39 will be intermeshed with lower gripping 86. To add another section of pipe, the rotary is raised until shoulder 89 of the pipe collar 27 is higher than the work table 21. Hydraulic motor 29 is then energized to move the work table 21 and opening 93 around pipe 24, as shown in FIG. 2. Rotary 19 is moved down until shoulder 89 bears the weight of the string and rotated until slots 87 align with the dogs of lower gripping assemblies 86. Lower gripping assemblies 86 are then energized to insert the dogs 59 into the slots. Pin 67 and slot 65 (FIGS. 6 and 8) allow self alignment. Dogs 39 restrain pipe 24 from rotating while rotary 19 is reversed to breakout its connection with pipe 24. Another pipe 24 is picked up and the process is repeated.

To remove drill pipe, the top or first pipe section **24*a*, which is attached to the rotary threaded pin 25, is drawn from the borehole until collar 27 of the second or next lower pipe section 24*b* is higher than slips 23. The work table 19 is moved into position around pipe 24*b* as shown in FIG. 2. Carriage 13 is moved down until opening 93 supports shoulder 89, and rotary 19 is rotated to align slots 87 with the dogs of the lower gripping assemblies 86. The lower gripping assemblies 86 are then energized to restrain the second pipe section 24*b* from rotating. Hydraulic cylinder 79 is then actuated to move dogs 59 of the upper gripping assemblies 39 into contact with the collar 27 of the upper pipe 24*a*. Hydraulic cylinders 85 are then actuated to rotate wrench housing 35 until the dogs from one pair slide into one pair of slots 87 of the upper pipe section 24*a*, as shown in FIG. 3. Rotation of wrench housing 35 is continued until the lower connection, designated as 95, in FIG. 1 is broken. During rotation by the wrench, the rotaty is in neutral, or a slight amount of reverse power may be applied to it if desired. The reverse power applied to the rotary will augment the hydraulic cylinder power. The reverse power should not be applied to an extent that may cause the upper connection to break before the lower connection is broken. After the initial break, the upper gripping assemblies 39** are retracted, allowing the rotary to spin out the lower connection.

The carriage is then tilted to place the pipe on the pipe rack. To disconnect the pipe section **24*a* from the rotary threaded pin 25, the rotary is rotated to align slots 87 with the dogs of the upper gripping assemblies 39. After engagement, by gripping assemblies 39, the rotary is reversed to break the upper connection with the pipe 24*a*, with the wrench assembly 33** serving as backup. This process is repeated for each section to be removed from the borehole.

The dogs of the upper gripping assemblies can be aligned with slots by rotating the wrench housing either prior to actuating them or after actuation. In either case, since the slots are 90 degrees apart, and the gripping assembly pairs are 45 degrees apart. The wrench housing 35 will never have to rotate more than 45 degrees to align the dogs with the slots. For the breakout operation, 15 degrees of rotation is sufficient to loosen the connection with the type of pipe preferrably used.

It should be apparent that an invention having significant advantages has been provided. The wrench apparatus, by being rotatably powered independent of the rotary, is able to quickly and efficiently remove sections of pipe. By using the wrench apparatus to grip and rotate the first section of pipe, the lower connection is assured of breaking out first. The upper connection is easily broken later by using the rotary to perform the breakout, with the wrench serving as backup. The self aligning structure in the gripping assembly assures that even contact is made between the dogs and the slot sidewalls. The offset spacing of the upper and lower gripping assemblies allows them to intermesh when the rotary is at its lowermost position. This avoids the need for a mechanism for pivoting the wrench apparatus out of the way when not in use.

While the invention has been shown in only one of its forms, it should be apparent to those skilled in the art that it is not so limited but is susceptible to various changes and modifications without departing from the spirit thereof.

We claim:

1. In an earth boring machine of a type having a mast, movable carriage means mounted to the mast and powered for generally up and down movement along the mast, rotary drive means mounted in the carriage means for rotating a string of drill pipe, an improved means for making up and breaking out sections of the drill pipe, comprising:

wrench means mounted to the carriage means for gripping the first section of pipe;

slip means mounted to the machine for gripping the second section of pipe and for supporting the drill string;

the wrench means being power driven for breaking the connection of the first pipe section with respect to the second pipe section;

the wrench means and the rotary drive means being capable of a selected amount of rotational displacement with respect to each other while the wrench means is gripping the first pipe section, for making up and breaking out the connection of the first pipe section with the rotary drive means.

2. In an earth boring machine of a type having a mast, movable carriage means mounted to the mast and powered for generally up and down movement along the mast, rotary drive means mounted in the carriage means for rotating a string of drill pipe, an improved means for making up and breaking out sections of the drill pipe comprising:

wrench means mounted to the carriage means for gripping the first section of pipe;

slip means mounted to the machine for gripping the second section of pipe and for supporting the drill string;

the wrench means being power driven for breaking the connection of the first pipe section with respect to the second pipe section;

the rotary drive means being capable of rotation with respect to the wrench means while the wrench means is gripping the first pipe section for making up and breaking out the connection of the first pipe section with the rotary drive means.

3. In an earth boring machine of a type having a mast, movable carriage means mounted to the mast and powered for generally up and down movement along the mast, rotary drive means mounted in the carriage means for rotating a string of drill pipe, an improved means for making up and breaking out sections of the drill pipe, comprising:

wrench means mounted to the carriage means for gripping the first section of pipe;

slip means mounted to the machine for gripping the second section of pipe and for supporting the drill string;

the wrench means being powered independently of the rotary drive means and having sufficient torque to breakout the connection of the first pipe section to the second pipe section;

the rotary drive means being rotatable with respect to the wrench means while the wrench means is gripping the first pipe section, and the rotary drive means having sufficient torque to breakout the connection of the first pipe section with the rotary drive means.

4. In an earth boring machine of the type having a mast, movable carriage means mounted to the mast, rotary drive means mounted in the carriage means for rotating a string of drill pipe, power means for moving the carriage means generally up and down the mast to move the drill pipe through a work table and in a borehole, and slip means mounted at the work table for gripping a pipe section and supporting the drill string, an improved wrench means for making up and breaking out sections of the drill pipe comprising:

gripping means mounted to the carriage means for gripping the first section of pipe;

a hydraulic cylinder connected between the carriage and the gripping means transverse to the drill string for rotating the gripping means a selected amount to break the connection of the first pipe section with the second pipe section while the second pipe section is restrained by the slip means;

the rotary drive means and the gripping means being capable of a selected amount of rotation with respect to each other for making up and breaking out the connection of the first pipe section with the rotary drive means.

5. The earth boring machine according to claim 4 wherein the rotary drive means has sufficient torque for breaking out its connection with the first pipe section while the first pipe section is being restrained from movement by the gripping means.

6. In an earth boring machine of the type having a mast, movable carriage means mounted to the mast, rotary drive means mounted in the carriage means for rotating the string of drill pipe, power means for moving the carriage means generally up and down the mast to move the drill pipe through a work table and in a borehole, and slip means mounted at the work table for gripping a pipe section and supporting the drill string, an improved means for making up and breaking out sections of the drill pipe, comprising:

a plurality of vertical slots formed in the upper collar of each pipe section;

a wrench housing mounted slidably to the carriage for rotational movement with respect to the carriage;

a pair of gripping assemblies mounted opposed to each other on the wrench housing, each gripping assembly having a rectangular configuration for reception within one of the slots;

reciprocating means connected with the gripping assemblies for actuating the dogs to move them transverse to the pipe axis into and out of engagement with the slots; and a hydraulic cylinder connected between the carriage means and the wrench housing, the hydraulic cylinder being oriented transverse to the pipe axis so that stroking the hydraulic cylinder causes rotation of the wrench housing with respect to the carriage means, for breaking out the connection of the first pipe section with the second pipe section while the second pipe section is being gripped by the slip means;

the wrench housing being independent of the rotational movement of the rotary drive means, allowing the connection between the first pipe section and the rotary drive means to be broken.

7. The apparatus according to claim 6 wherein the rotary drive means has sufficient torque to break the connection of the first pipe section with the rotary drive means while the hydraulic cylinder prevents the wrench housing and the first pipe section from rotation.

8. The earth boring machine according to claim 6 wherein each of the gripping assemblies comprises:

a dog assembly mounted to the wrench housing having a bore, and open inner end, and a closed outer end;

a piston carried reciprocally in the bore, with the dog mounted to the face of the piston;

a pin fixed to the dog assembly housing and inserted into a groove in the piston; the groove being larger in width than the diameter of the pin to allow the piston to pivot about its axis a selected amount for self aligning the dog with the slots; and linkage means connecting the piston to the reciprocating means for reciprocating the piston in the bore along its axis.

9. In an earth boring machine of the type having a mast, movable carriage means mounted to the mast, rotary drive means mounted in the carriage means for rotating a string of drill pipe, power means for moving the carriage means generally up and down the mast to move the drill pipe through a work table and in a borehole, an improved means for making up and breaking out sections of the drill pipe comprising:

at least four vertical slots in the upper collar of each pipe section spaced equally around the pipe wall;

a wrench housing mounted slidably to the bottom of the carriage for rotational movement with respect to the carriage;

two pairs of upper gripping assemblies mounted to the wrench housing, the gripping assemblies in each pair mounted on opposite sides of the pipe, the pairs being spaced apart from each other by an acute angle $\alpha$;

one pair of lower gripping assemblies mounted to the work table on opposite sides of the pipe;

each gripping assembly having a dog of retangular configuration adapted for reception within one of the slots;

reciprocating means connected with each gripping assembly for actuating the dogs to move them in a plane perpendicular to the pipe axis into and out of engagement with the slots; and a hydraulic cylinder connected between the carriage means and the wrench housing in a plane transverse to the pipe axis so that stroking the hydraulic cylinder causes rotation of the wrench housing with respect to the carriage means, for breaking out the connection of the first pipe section with the second pipe section while the second pipe section is being gripped by the slip means;

the hydraulic cylinder having sufficient capacity to prevent rotational movement of the wrench housing and the first pipe section while the rotary drive means is rotated in reverse to breakout the connection of the first pipe section with the rotary drive means;

the upper gripping assemblies lying in different vertical planes than the lower gripping assemblies when the hydraulic cylinder is retracted, allowing them to intermesh when the rotary drive means is lowered to the working table.

10. The earth boring machine according to claim 9 wherein the angle $\alpha$ is substantially 45 degrees.

11. The earth boring apparatus according to claim 9 wherein each of the gripping assemblies comprises:

a dog assembly housing having a bore;

a piston carried reciprocally in the bore, with the dog mounted to the face of the piston;

linkage means connecting the piston to the reciprocating means for reciprocating the piston along its axis; and self aligning means for allowing the piston to pivot a selected amount about its axis to self align the dogs with the slots in the pipe.

12. In an earth boring machine of a type having a mast, movable carriage mounted to the mast, rotary drive means mounted in the carriage means for rotating a string of drill pipe, power means for moving the carriage means generally up and down the mast, to move the drill pipe through a work table and in a borehole, an improved means for gripping the pipe, comprising:

a plurality of vertical slots formed in the upper collar of each pipe section;

a pair of housings mounted opposed to each other on the machine, each housing having a central bore, an open inner end and a closed outer end;

a piston reciprocally carried in the bore;

a rectangular dog mounted to the face of the piston and adapted to engage the slots of the pipe sections;

reciprocating means, connected to the end of the piston for reciprocating it in the bore to engage and disengage the dogs in the slots; and a pin fixed to the housing and inserted into a groove in the piston to allow the piston to pivot about its axis a selected amount for self aligning the dogs with the slots.

13. The earth boring machine according to claim 12 wherein the pin is fastened to the end wall of the housing and extends parallel with the axis of the bore; and wherein the groove is formed in the end of the piston.

14. A method of removing drill pipe from a borehole with an earth boring machine of a type having a mast, movable carriage means mounted to the mast, rotary drive means mounted in the carriage means for rotating a string of drill pipe, power means for moving the carriage means generally up and down the mast to move the drill pipe through a work table and in a borehole, and slip means mounted at the work table for gripping a pipe section and supporting the drill string, comprising:

pulling the drill string upward with the carriage means until the connection between the first and second pipe sections is at the slip means;

engaging the slip means to support the drill string and prevent rotation of the second pipe section;

providing a wrench that is rotationally powered independently of the rotary drive means and rotatable independently of the rotary drive means, and mounting it to the carriage means;

actuating the wrench to grip the first pipe section and then rotating the wrench to break the connection between the first and second pipe sections;

retracting the wrench and rotating the rotary drive means in reverse to remove the first pipe section from the second pipe section; then engaging the wrench to grip the first pipe section and rotating the rotary drive means in reverse while the wrench restrains the first pipe section from movement, to breakout the first pipe section from the rotary drive means.

* * * * *